United States Patent [19]

Chung

[11] 4,345,337

[45] Aug. 24, 1982

[54] MAN'S BRIEFS

[76] Inventor: Seun Y. Chung, 1102 Shinrim 8-dong, Kwanak-ku, Seoul, Rep. of Korea

[21] Appl. No.: 179,482

[22] Filed: Aug. 19, 1980

[51] Int. Cl.[3] ..... A41B 9/02

[52] U.S. Cl. ..... 2/405; 128/159

[58] Field of Search ..... 2/403, 404, 405; 128/159

[56] References Cited

U.S. PATENT DOCUMENTS 3,844,282 10/1974 King ..... 2/405 X

FOREIGN PATENT DOCUMENTS 76166 1/1950 Norway ..... 2/405

280164 4/1952 Switzerland ..... 2/405

459968 1/1937 United Kingdom ..... 2/405

529742 11/1940 United Kingdom ..... 2/405

*Primary Examiner*—H. Hampton Hunter

*Attorney, Agent, or Firm*—Oblon, Fisher, Spivak, McClelland & Maier

[57] ABSTRACT

A man's briefs having an opening formed therein including a cover member attached to the briefs and located adjacent the opening formed in the briefs, a band-type ring attached to an upper portion of the opening formed in the briefs, a rubbing cloth attached to an interior portion of the cover and a plurality of wrinkles formed on a bottom portion of the cover. The cover member can overlap the opening formed in the briefs.

2 Claims, 4 Drawing Figures

MAN'S BRIEFS

BACKGROUND OF THE INVENTION

Field of the Invention

The present invention relates to improved briefs worn by men.

Description of the Prior Art

Prior briefs worn by men generally cover the lower part of the body and have an opening for urination. Because of a low ventilation chracteristic of such briefs, the user of such briefs is liable to develop a skin disease around the genitals of the body. Even one of prior art briefs, laid open Japanese Open Utility Model Publication No. 48-41417 which is characterized by an opening on the front of the briefs and the cover on the outside thereof, could not avoid the above defect, since such does have not any specific structure for separating the penis and the seminal vesicle from each other and the cover often pushes the penis into the inner side of these briefs.

Summary of the Invention

An object of the present invention is to overcome such defect of prior briefs so as to provide the user not only a cool and refreshing feeling around the genitals and lower part of the body but to also improve the sexual activity of the user.

The present invention is characterized by a band-type ring on which the penis is hung, a number of the wrinkles formed on the sealing portion at the bottom of a cover providing a broad space between the briefs and the cover and a rubbing cloth attached to the cover.

Various other objects, features and attendant advantages of the present invention will be more fully appreciated as the same becomes better understood from the following detailed description when considered in connection with the accompanying drawings in which like reference characters designate like or corresponding parts throughout the several views, and wherein.

DETAILED DESCRIPTION OF THE PREFERRED EMBODIMENTS

Figure 1:
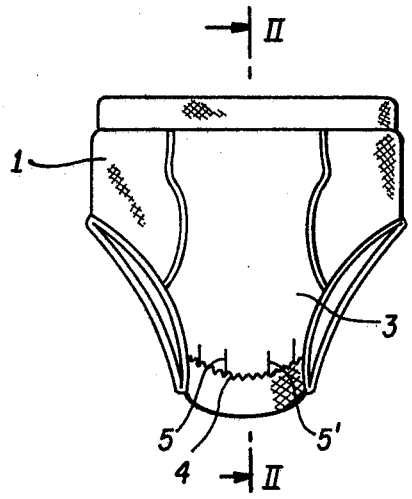
FIG. 1 is a front elevational view of a man's briefs which constitute the present invention.
Figure 2:
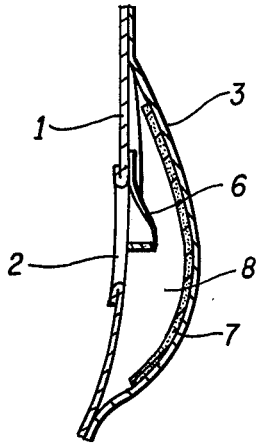
FIG. 2 is a vertical sectional view of the briefs taken along line line II—II of FIG. 1.
Figure 3:
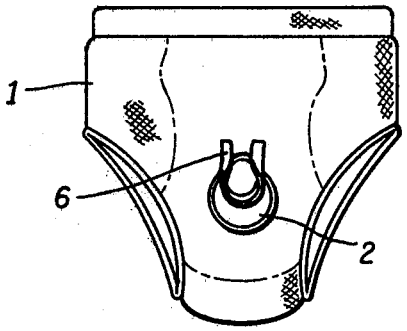
FIG. 3 is a front elevational view of the briefs showing the band-type ring.
Figure 4:
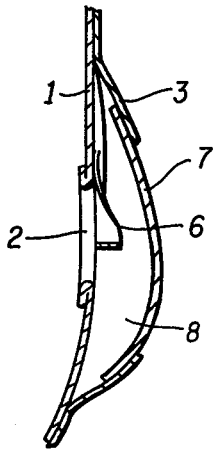
FIG. 4 is a vertical sectional view of a modified example of the briefs of the present invention.

Describing the present invention in greater detail on the basis of the drawing, it is It is initially noted that in addition to opening 2 and a cover 3 on the front thereof, used in prior briefs, the present briefs consist of a number of wrinkles 5, 5' formed on the sealing portion 4 at the bottom of a cover 3, a band-type ring 6 attached to the upper part of the opening 2 and a rubbing cloth 7 attached in the cover 3 on the outside of the opening 2.

As for the rubbing cloth, it is desirable to use coarse-grained fabrics such as hemp-woven fabrics, so that the penis can be rubbed.

When a man wears the briefs of the present invention, he takes out the penis and the seminal vesicle from the inside the briefs 1 and place them in the space 8 between the briefs 1 and the cover 3 through the opening 2. He then hangs his penis on the band-type ring 6, so that the penis and the seminal vesicle can be effectively separated from each other.

Because the penis is hung on the band-type ring 6 and the seminal vesicle is placed in the space 8, the ventilation rate around the genitals can be raised and the sweat generated between the penis and the seminal vesicle can be easily absorbed. Consequently the user can benefit from a continuous a cool and refreshing feeling. Because the penis hung on the band-type ring (6) and the rubbing cloth (7) attached to the cover 3 rubbed each other, the senses of the penis grow dull and therefore, the user can improve his sexual activity. Because the plurality of the wrinkles 5, 5' formed on the bottom of the cover 3 broaden the space between the briefs 1 and the cover 3, the occurrence of the cover 3 pushing the penis and the seminal vesicle into the interior of the briefs is avoided.

Obviously, many modifications and variations of the present invention are possible in light of the above teachings. It is therefore to be understood that within the scope of the appended claims the invention may be practiced otherwise than as specifically set forth herein.

What is claimed as new and intended to be secured by Letters Patent of the United States is:

1. Briefs for the support of male genetalia, said genetalia including a penis and a seminal vesicle, said briefs having an opening formed therein for the passage of said genetalia and comprising:

a cover member attached to said briefs and located adjacent said opening formed in said briefs, said cover member and said briefs forming a space for the placement of said genetila;

a band-type ring for support of said penis attached to an upper portion of said opening formed in said briefs, said ring having a lower arcuate supporting surface disposed substantially perpendicular to said opening for supporting said penis such that said penis is separated from and prevented from contacting said seminal vesicle;

a coarse rubbing cloth attached to an interior portion of said cover member such that said rubbing cloth rubs said penis and dulls the senses of said penis; and a plurality of wrinkles formed on a bottom portion of said cover.

2. Briefs as set forth in claim 1, wherein said cover member overlaps said opening formed in said briefs.

* * * * *